US006450874B2

(12) United States Patent
Hoyez et al.

(10) Patent No.: US 6,450,874 B2
(45) Date of Patent: Sep. 17, 2002

(54) THERMOSTATICALLY CONTROLLED POWER DRAFT MOTOR COOLING SYSTEM

(75) Inventors: Timothy G. Hoyez, Circle Pines, MN (US); John R. Weimer, Minneapolis, MN (US)

(73) Assignee: Tjernlund Products, Inc., White Bear Lake, MN (US)

( * ) Notice: Subject to any disclaimer, the term of this patent is extended or adjusted under 35 U.S.C. 154(b) by 0 days.

(21) Appl. No.: 09/774,277

(22) Filed: Jan. 30, 2001

Related U.S. Application Data

(60) Provisional application No. 60/223,380, filed on Aug. 7, 2000.

(51) Int. Cl.[7] ..... F23L 17/12
(52) U.S. Cl. ..... 454/16; 110/162
(58) Field of Search ..... 454/11, 15, 19, 454/16; 165/47

(56) References Cited

U.S. PATENT DOCUMENTS

| | | | | | |
|---|---|---|---|---|---|
| 3,782,303 | A | * | 1/1974 | Pfister et al. | 126/312 |
| 4,008,655 | A | * | 2/1977 | Rahman | 165/128 |
| 4,069,668 | A | * | 1/1978 | Oldberg | 60/317 |
| 4,262,608 | A | | 4/1981 | Jackson | |
| 4,550,772 | A | * | 11/1985 | Knoch | 165/47 |
| 4,580,621 | A | * | 4/1986 | Lovrich et al. | 165/47 |
| 4,596,288 | A | * | 6/1986 | Knoch | 165/901 |
| 4,689,507 | A | * | 8/1987 | Baker et al. | 310/62 |
| 4,856,982 | A | | 8/1989 | Olson | |
| 5,012,793 | A | | 5/1991 | Guzorek | |
| 5,167,216 | A | * | 12/1992 | Yeung et al. | 126/349 |
| 5,261,389 | A | | 11/1993 | Trieb | |
| 5,375,651 | A | | 12/1994 | Colwell | |
| 5,944,090 | A | * | 8/1999 | Teal | 165/47 |
| 6,085,700 | A | * | 7/2000 | Overbey, Jr. | 122/13.1 |

OTHER PUBLICATIONS

Web–based Exhausto Advertisement, 1 page.
Web–based Exhausto Advertisement, 1 page.
Web–based Exhausto, Inc. Advertisement, 2 pages.
Exhausto Brochure, 8 pages.

* cited by examiner

*Primary Examiner*—Harold Joyce
*Assistant Examiner*—Derek S. Boles
(74) *Attorney, Agent, or Firm*—Patterson, Thuente, Skaar & Christensen, P.A.

(57) ABSTRACT

A variable speed power flue ventilator with a thermostatically controlled motor cooling system. The thermostatically controlled cooling system employs an auxiliary motor cooling fan separate from the fan used by the power ventilator to extract exhaust gases. A thermostatic sensor switch actuates the motor cooling fan whenever the temperature in the exhaust fan motor housing rises to a preset value. The cooling fan then draws cool ambient air through the motor housing until the enclosed housing area reaches a second lower, preset temperature at which point the cooling fan is shut off by the thermostat.

24 Claims, 6 Drawing Sheets

THERMOSTATICALLY CONTROLLED POWER DRAFT MOTOR COOLING SYSTEM

RELATED APPLICATION

The present application claims the benefit of U.S. provisional application No. 60/223,380 filed Aug. 7, 2000, which is incorporated herein in its entirety by reference.

FIELD OF THE INVENTION

The present invention relates to power draft systems for exhausting hot flue gases. More particularly, the invention relates to a power draft system with a thermostatically controlled fan for cooling the motor of the ventilator.

BACKGROUND OF THE INVENTION

Chimneys first became common in Europe in the $16^{th}$ century. Despite improvements in design since then, most chimneys still operate on a natural draft system. A natural draft chimney operates by force of gravity. That is, the hot flue gases in the chimney are lighter than the surrounding ambient air. Being lighter, flue gases are displaced by cooler, heavier air and rise buoyantly through the chimney flue creating a natural draft.

The efficiency of natural draft chimneys is affected by a host of environmental factors. Ambient air temperature and atmospheric pressure affect the density of the ambient air mass. If the density of the ambient air mass is reduced, the draft efficiency of the chimney is reduced as well.

Wind can either increase draft by blowing across the mouth of the chimney creating a venturi effect or reduce draft if turbulent and can even cause a back draft, a reverse flow through the chimney, causing flue gases to be vented within the building.

Factors related to fuel burning appliances also affect the efficiency of natural draft chimneys. Efforts to increase the energy efficiency of heating appliances have resulted in those appliances extracting as much heat as possible from the exhaust gases thereby reducing the exhaust gas temperature. Reduced exhaust gas temperatures increase exhaust gas density and lessen draft.

Modern boiler systems are designed to operate in modular or modulated fashion. Modular boilers operate in such a way that a number of small boilers may be used individually, in groups or all at one time dependent upon heating demand. A modulated boiler may burn at variable rates in response to heating demand. Typically, modular and modulated boiler systems are vented through a single flue. Other fuel burning appliances such as water heaters may also vent through the common flue. The chimney flue must be sized based on the maximum firing rate of all the units combined. When all of the units are not in use the flue becomes oversized for the task and cannot provide a proper draft.

These factors create the potential for insufficient draft which may cause condensation within the flue, back drafts, or flue gas spillage. Condensation is a particular concern since flue gases may contain substances such as sulfur oxides that, when combined with water, form acids. Acids can lead to corrosive destruction of the flue itself as well as damage to heating equipment. Corrosion damage along with back drafts and flue gas spillage can lead to health and safety concerns for occupants of the building if flue gases escape into living areas.

All of these factors have lead to the increasing popularity of power venting systems to ensure the proper venting of hot flue gases. Power draft systems fall into two basic classes. The traditional mechanical draft system is a so called constant volume system in which a fan provides a constant volume gas flow through the flue to carry exhaust gases to the exterior of the structure. The constant flow of air through these continuously operating systems is inefficient and costly. Three to five thousand cubic feet per minute of air may be expelled by these systems causing loss of heat in the winter and loss of cooled air in the summer.

More recently, constant pressure systems have been introduced. Constant pressure systems include a fan located at the chimney termination as well as a control system that maintains appropriate draft by adjusting the airflow to maintain a constant negative pressure within the flue. In order to maintain a constant relatively reduced pressure within the flue the airflow is continuously adjusted. One way to accomplish this is by operating the exhaust blower at a variable speed. A variable speed motor is called upon to increase airflow when a greater draft is needed and to reduce airflow when a lesser draft is required.

The application of power draft systems also allows the use of smaller ducts to carry exhaust gases and to provide combustion air. This can present a large cost savings. Due to corrosion concerns, exhaust ducts are more often being constructed from special corrosion-resistant steels such as Allegheny Ludlum™ AL29-4C. Ductwork made of specialty steels of this type can be very expensive.

The use of smaller ductwork also makes for easier installation since ductwork may pass through smaller chases and smaller openings in partitions are required. Smaller openings require less structural reinforcement than large ones.

In normal operation, electric motors produce waste heat because of friction and electrical resistance. Generally, this heat is dissipated by a constant airflow through the motor housing produced by a fan attached to the motor shaft, which draws cooling air over the bearings and windings of the motor. In a variable speed blower, such airflow is of course reduced when the motor is operating at lower speed. If the motor were operating in a normal ambient air environment, it would not necessarily be subject to overheating at lower speeds because the motor windings and bearings produce less waste heat at lower operating speeds. A power ventilator motor, however, necessarily operates in a high temperature environment due to its proximity to high temperature flue gas.

One approach to mitigating the excess heat problem, caused when a power ventilator is operated at low speeds, is to employ a motor with insulated windings. A, so-called, H-class motor has specially insulated windings to protect the windings from damage due to excess heat exposure. However, the motor bearings in an H-class motor are not protected, and may fail prematurely due to excess heat buildup. Additionally, heavy duty insulated motors may be prohibitively expensive.

Power flue ventilators may also be constructed with massive heat conductive housings to provide a heat sink and to radiate excess heat. Massive housings are expensive and excess weight may require strengthening of flue installations.

It would be desirable to have a variable speed power flue ventilator which can utilize a relatively inexpensive motor, operate at variable speed while proximate to high temperature flue gases, and yet still maintain long motor life.

SUMMARY OF THE INVENTION

The present invention in large part solves the problems referred to above, by providing a variable speed power flue ventilator with a thermostatically controlled motor cooling system.

The thermostatically controlled cooling system employs an auxiliary motor cooling fan separate from the blower used by the power ventilator to extract exhaust gases. A thermostatic sensor switch actuates the motor cooling fan whenever the temperature in the exhaust fan motor housing rises to a preset value. The cooling fan then draws cool ambient air through the motor housing until the enclosed housing area reaches a second, lower, preset temperature at which point the cooling fan is shut off by the thermostat.

In addition, the power ventilator of the present invention includes a thermostatic safety shut off switch. If the interior of the motor housing reaches a preset temperature high enough to threaten immediate damage to the motor, the safety shut off then shuts off the fuel burning appliance system and keeps it off until appropriate cooling has occurred. During the time that the fuel burning appliance is shut off, the auxiliary cooling fan continues to operate to dissipate heat from the motor and motor housing until the temperature reaches a safe level.

It is notable that the cooling air intakes for the motor cooling system are located below and outside of the flue gas exhaust ports. This assures that air drawn in to cool the motor will be cool ambient air, not hot exhaust gas.

DETAILED DESCRIPTION OF THE INVENTION

Figure 1:
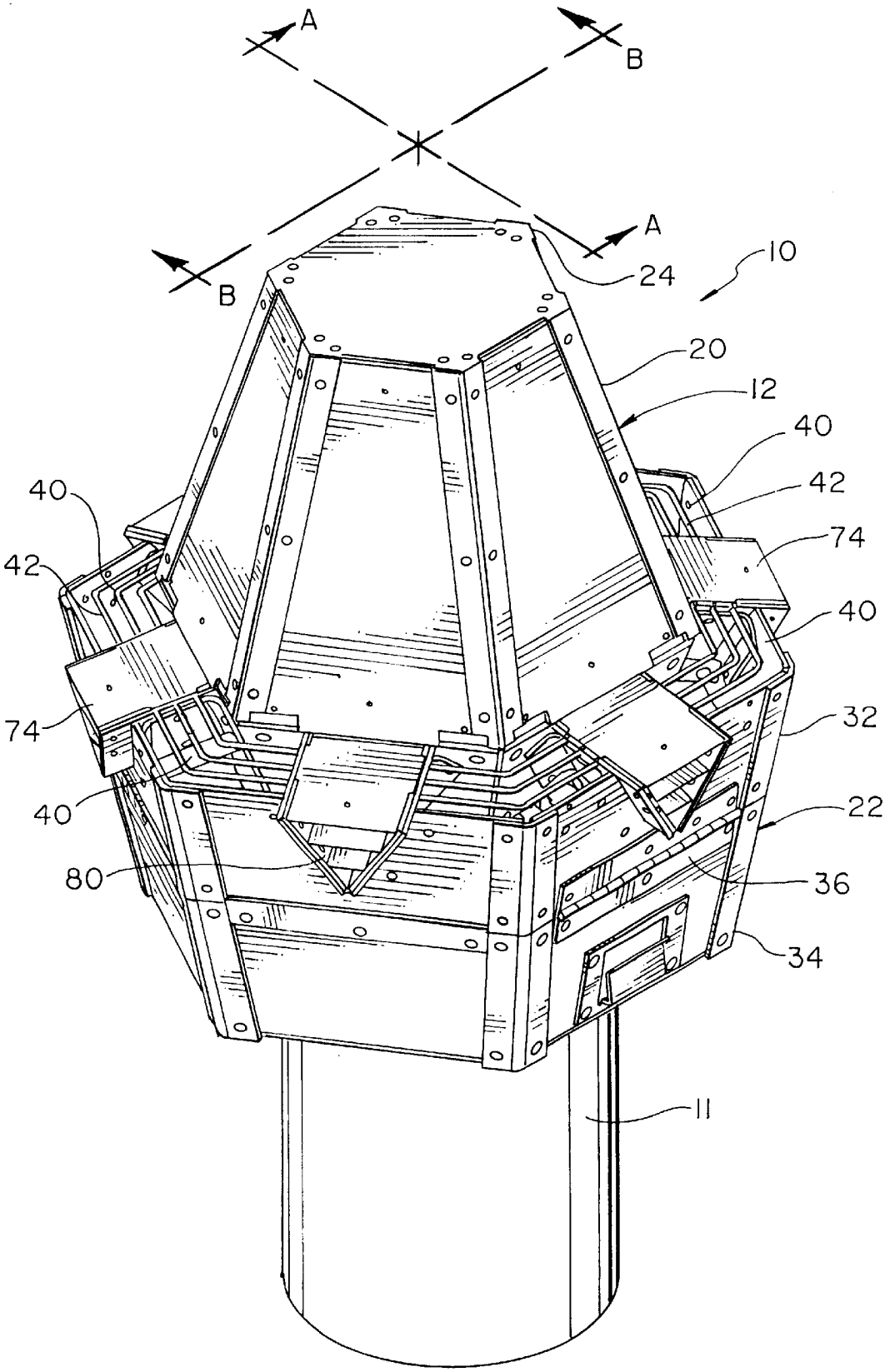
FIG. 1 is a perspective view of a power flue draft system in accordance with the present invention.
Figure 3:
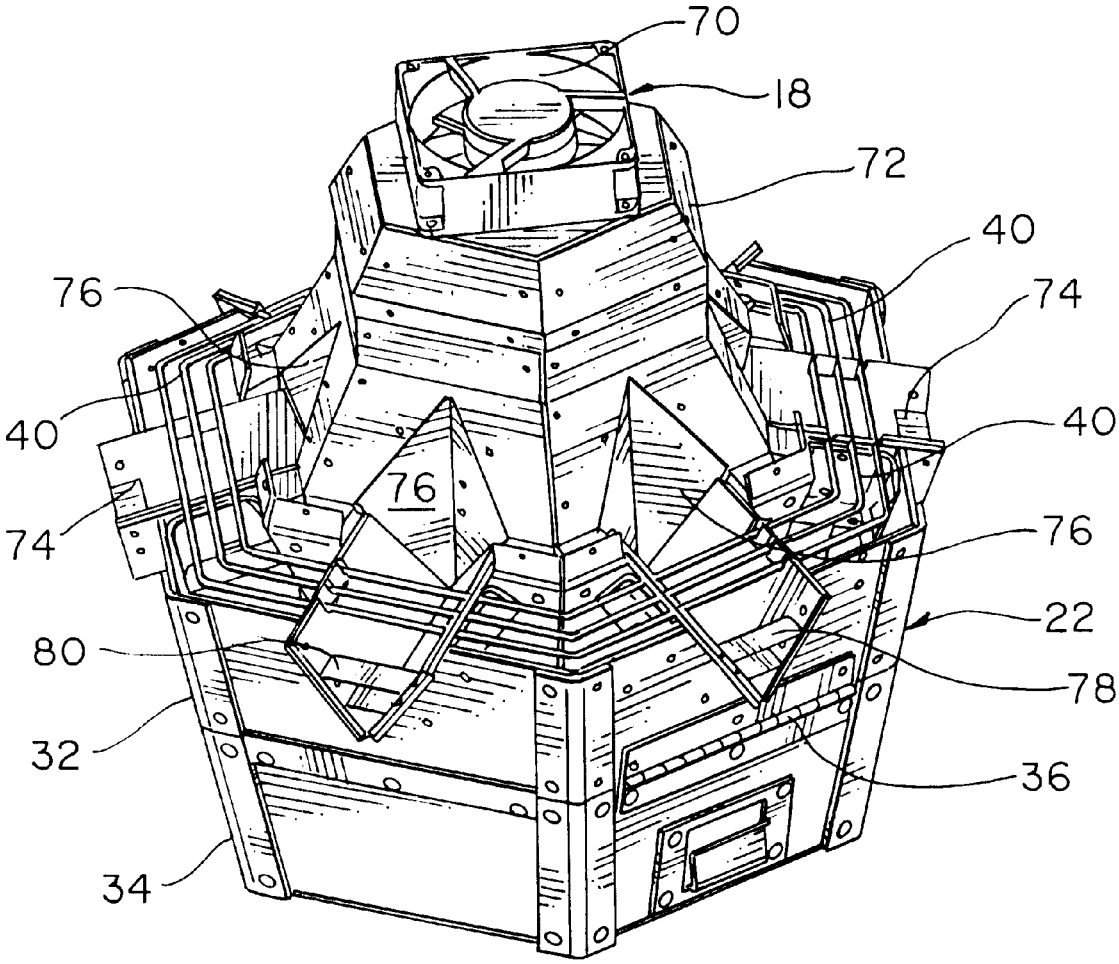
FIG. 3 is a perspective view of the power flue draft system with the motor cover removed depicting the motor cooling system.
Figure 5:
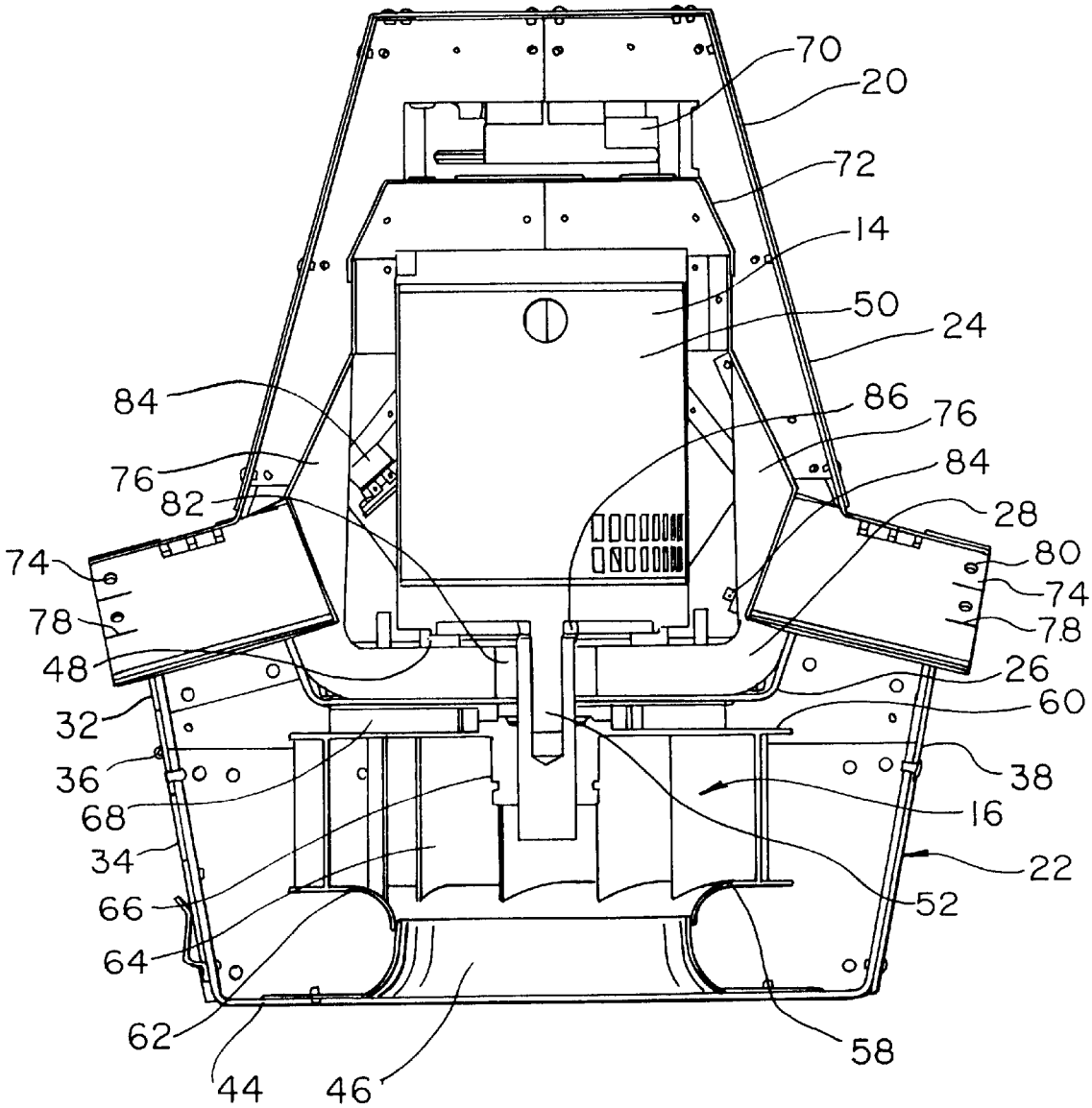
FIG. 5 is a cross-sectional view of the power flue draft system sectioned along a plane dropped from line A—A in FIG. 1.

Referring in particular to FIGS. 1, 3, and 5, a power flue ventilator 10 for extracting flue gases from a flue 11, in accordance with the present invention, generally includes an enclosure 12, a motor 14, an exhaust fan 16, and a motor cooling system 18.

The enclosure 12 includes motor housing 20 and exhaust fan housing 22 separated from but connected to motor housing 20. The motor housing 20 includes motor cover 24, motor pan 26, insulation 28, and tilt sensor switches 30. Motor pan 26 separates motor housing 20 from exhaust fan housing 22. Insulation 28 covers the surface of motor pan 26. Tilt sensor switches 30 are enclosed within motor cover 24.

Figure 2:
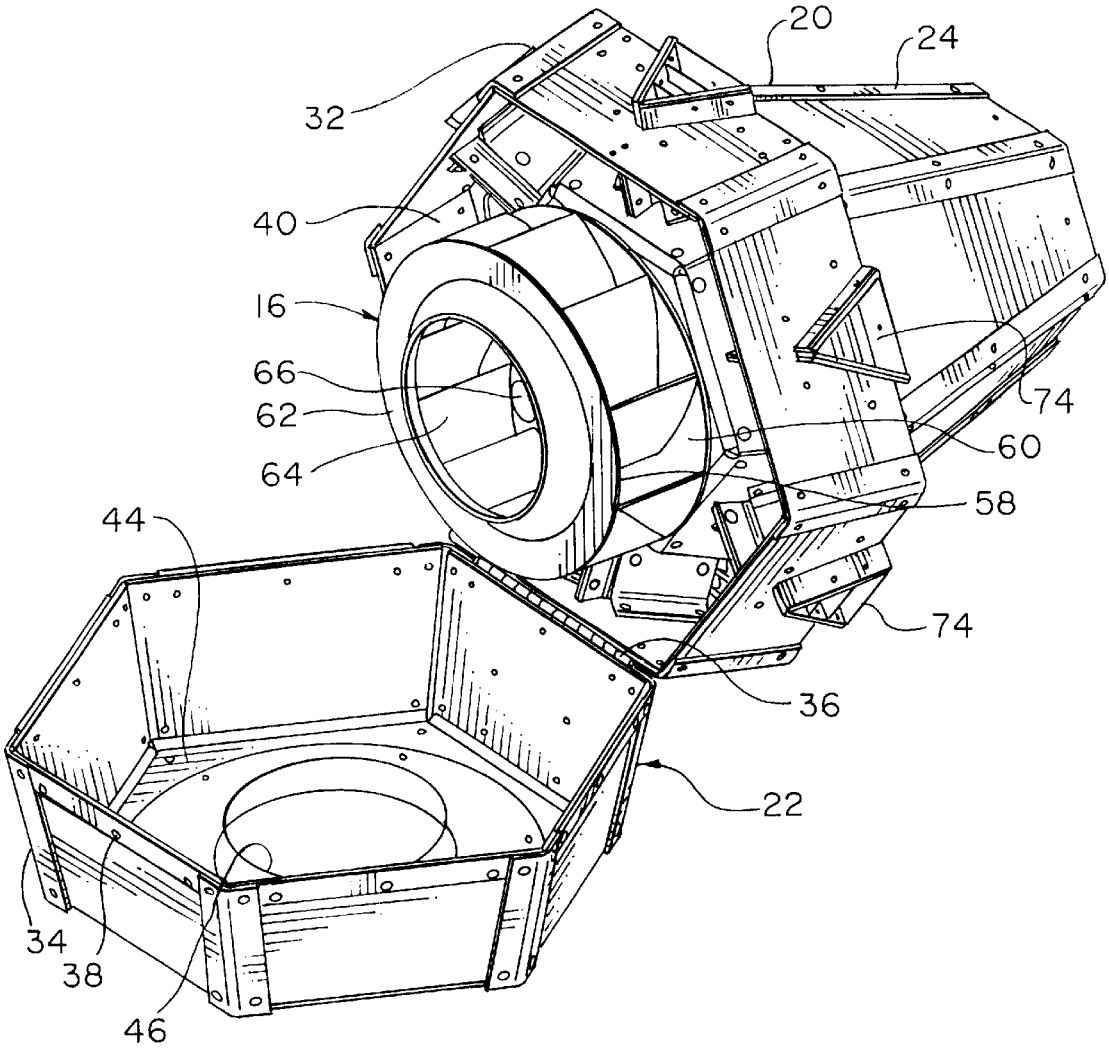
FIG. 2 is a perspective view of the power flue draft system depicted with the fan housing opened to reveal the exhaust fan impeller.

Referring particularly to FIG. 2, exhaust fan housing 22 includes an upper shell 32 and a lower shell 34. Upper shell 32 and lower shell 34 are movably coupled to one another by hinge 36 and secured by opposed latch 38.

Upper shell 32 includes flue gas exhausts 40 which are covered by grills 42. The bottom 44 of lower shell 34 defines flue gas inlet 46.

Figure 4:
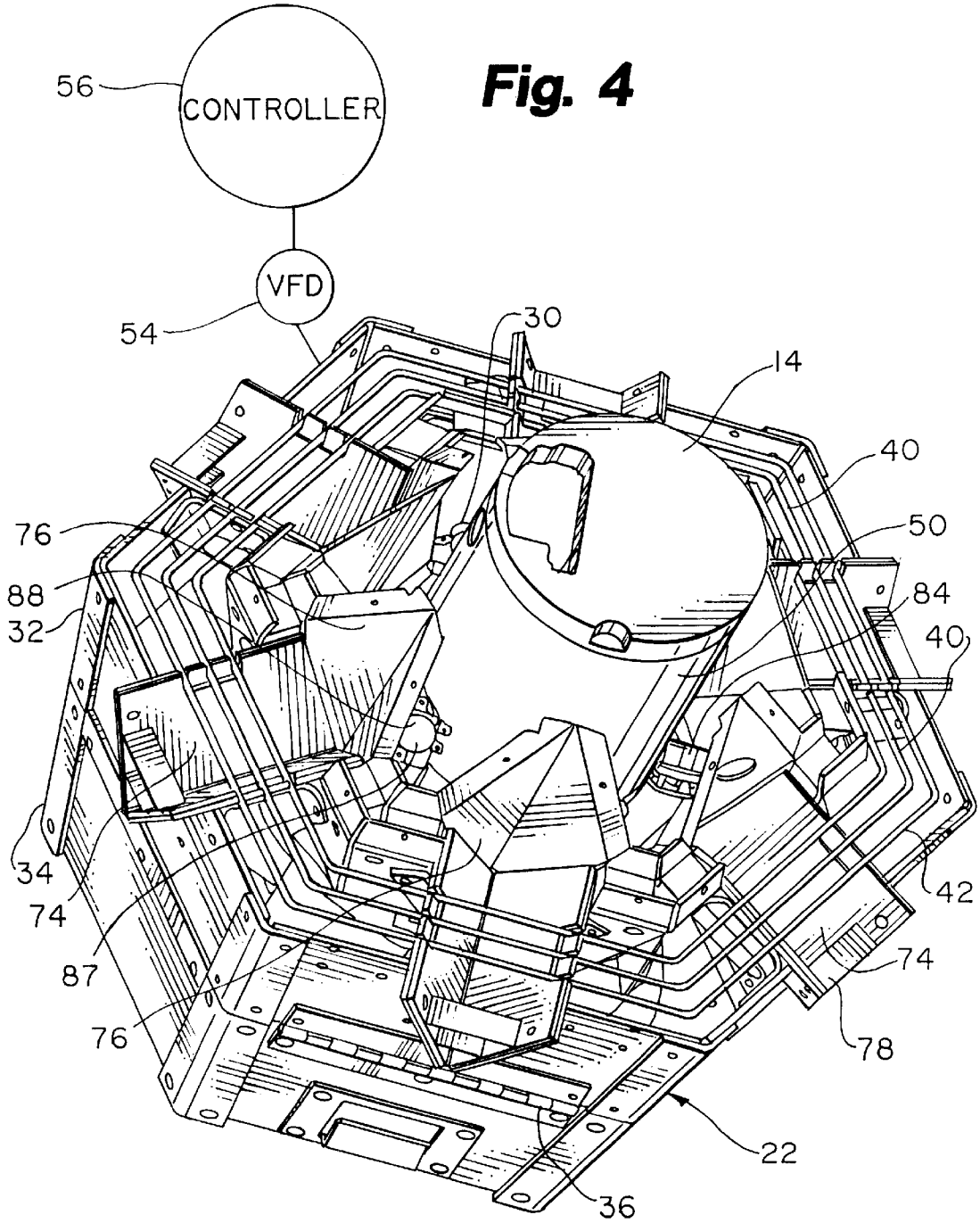
FIG. 4 is a perspective view of the power flue draft system with the cooling assembly removed to expose the motor.
Figure 6:
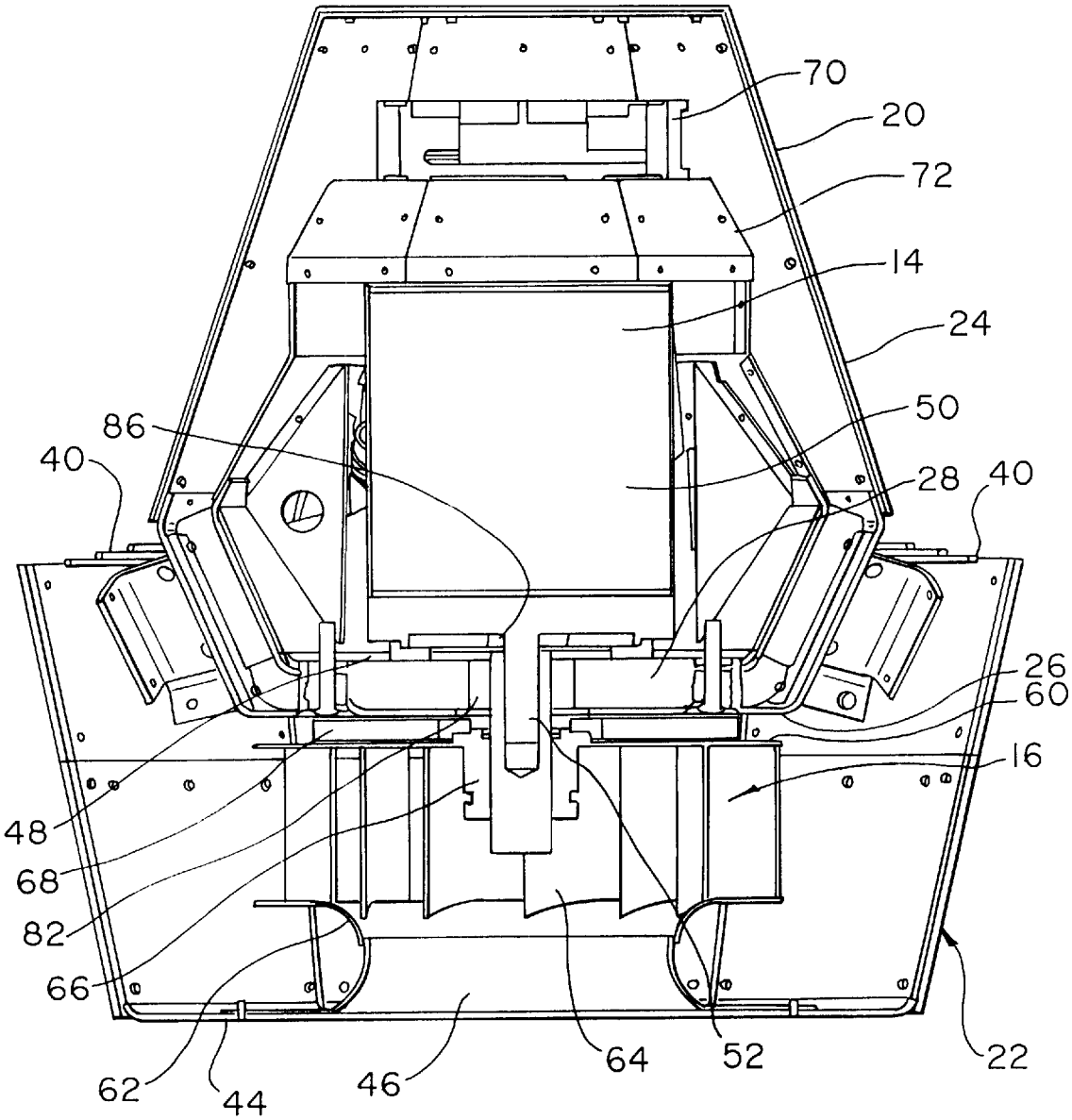
FIG. 6 is a cross-sectional view of the power flue draft system sectioned along a plane dropped from line B—B in FIG. 1.

Referring to FIGS. 4, 5 and 6, motor 14 is enclosed within motor housing 20. Motor 14 is secured to motor pan 26 above insulation 28. A space separates motor body 50 from insulation 28. Motor 14 is supported by motor supports 48. Motor 14 includes shaft 52. The motor 14 is oriented within the motor housing 20 such that shaft 52 passes through motor pan 26 into exhaust fan housing 22. Motor shaft 52 is preferably keyed.

Motor 14 may be of a conventional three phase, single speed type converted to operate at variable speed by use of a single phase and a variable frequency drive (VFD) 54. Motor 14 may be connected to a remotely located controller 56.

As depicted in FIGS. 2, 5, and 6, exhaust fan 16 is enclosed within exhaust fan housing 22. Exhaust fan 16 includes an impeller 58. Impeller 58 is preferably constructed of type 304 stainless steel, backward inclined in design and computer balanced. Impeller 58 includes a back plate 60, rim 62, blades 64, and hub 66. Hub 66 is preferably of the keyed-type and is mounted on shaft 52. Exhaust fan 16 may comprise any type of blower without departing from the spirit and scope of the invention. Other fan designs include other types of centrifugal fans or axial fans. Impeller 58 is located within exhaust fan housing 22 such that rim 62 is proximate to flue gas inlet 46.

Referring particularly to FIGS. 3, 5 and 6, motor cooling system 18 includes radial impeller 68, auxiliary cooling fan 70, and shroud 72. Radial impeller 68 is secured to back plate 60 on the side opposite blades 64. Auxiliary cooling fan 70 may be electrically powered and located on top of shroud 72. Auxiliary cooling fan 70 is preferably of permanently lubricated, all ball bearing construction. Shroud 72 encloses motor body 50 and is positioned within and spaced from motor cover 24.

Shroud 72, depicted in FIG. 3, includes air intakes 74 and deflectors 76. Louvers 78 are located within the mouth 80 of air intakes 74. Cooling air exhaust 82 surrounds shaft 52 and passes through motor pan 26. Air intakes 74 are located and directed away from flue gas exhausts 40.

Auxiliary cooling fan 70 is actuated by thermostatic switches 84. Thermostatic switches 84 are preferably located proximal to shaft 52 and shaft bearing 86. Thermostatic switches 84 are preferably configured to actuate auxiliary cooling fan 70 at a temperature of about 150° F. and to switch it off at a temperature of about 120° F.

Thermostatic safety control 87 includes shut-off switch 88 located proximate motor cooling system 18 and electrically connected to remotely located controller 56. Thermostatic safety shut-off switch 88 is preferably configured to actuate at about 190° F.

While this application discusses cooling with air as a coolant, it is contemplated that the disclosed coolant circulating device may operate with liquid coolant circulated about portions of the motor requiring cooling, with the liquid coolant being passed, for instance, through a radiator to dissipate heat outside the unit housing.

Portions of the flue exhaust systems, such as the flue gas intake and flue gas exhaust, may be treated with a corrosion resistant coating such as Ryton brand coating available from the Phillips 66 Company.

In operation, the power flue ventilator 10 is located at the exhaust end of a flue 11 and secured to the flue 11 via exhaust fan housing 22. The power flue ventilator 10 may be installed at the end of a vertical flue 11 or a horizontal flue 11. It is notable that when the power flue ventilator 10 is placed at the end of a horizontal flue 11 the power flue ventilator 10 may be oriented so that hinge 36 is at the bottom of the installation. This allows the exhaust fan housing 22 to be opened to provide access for cleaning or maintenance while preventing the housing from accidentally closing and potentially injuring a worker working on the power flue ventilator 10.

When required, power flue ventilator 10 draws flue gas from flue 11 and ejects it into the ambient atmosphere. Impeller 58 draws flue gas in through flue gas inlet 46 and expels it from exhaust fan housing 22 via flue gas exhausts 40.

Controller 56 may vary the speed at which motor 14 rotates in response to the draft demands of the fuel burning appliances. When power ventilator 10 exhausts flue gas, impeller 58 and exhaust fan housing 22 are of course exposed to high temperature flue gases that are extracted by power flue ventilator 10. This may cause motor 14, particularly in the area of shaft bearing 86, to be exposed to temperatures high enough to damage or at least accelerate the deterioration of motor 14.

When the power flue ventilator 10 is operating at a high speed, impeller 58 is turning rapidly carrying with it radial impeller 68. During high speed operation cooling air is drawn in through air intakes 74, deflected upward by deflectors 76, and travels through the space between motor housing 20 and shroud 72. Cooling air then passes through auxiliary cooling fan 70 to the interior of shroud 72 where it flows over motor 14, passes between motor 14 and insulation 28, flows around shaft 52 and particularly the region of shaft bearing 86, and passes through cooling air exhaust 82. Radial impeller 68 draws cooling air out into the interior of exhaust fan housing 22. Cooling air then exits exhaust fan 22 through flue gas exhaust 40 along with hot flue gases. It will be noted that air intakes 74 are located below and exterior to flue gas exhaust 40 assuring that cool ambient air will be drawn into air intakes 74.

Insulation 28 serves to reduce heat transfer from exhaust fan housing 22 into motor housing 20.

When motor 14 is operating at low speed, radial impeller 68 may not generate enough air movement around motor 14 to sufficiently cool it. Under these conditions, thermostatic switches 84 sense the rise in temperature. When the temperature reaches a predetermined value thermostatic switches 84 actuate auxiliary cooling fan 70 which draws cool air into the interior of shroud 72 and forces it over motor 14 where it is exhausted through cooling air exhaust 82 and thence outward through flue gas exhaust 40.

When the temperature inside shroud 72 has reached a sufficiently cool predetermined value, thermostatic switches 84 shut off auxiliary cooling fan 70. Under extreme heat conditions such as very high ambient temperatures or exposure to bright sunlight, the temperature inside shroud 72 may reach a very high value despite the operation of auxiliary cooling fan 70. Thermostatic safety shut-off switch 88 is actuated at a predetermined high temperature and signals controller 56 to shut off the heating appliance that is being exhausted. Controller 56 keeps the heating appliance shut off until the temperature within shroud 72 has cooled to an appropriate predetermined value.

Preferably, thermostatic switches 84 turn auxiliary cooling fan 70 on at a temperature of about 150° F. and turn it off again at a temperature of about 120° F. Thermostatic safety shut-off switch 88 shuts off the vented heating appliance when the temperature inside shroud 72 reaches about 190° F. Auxiliary cooling fan 70 continues to run while the heating appliance is off until the temperature within shroud 72 returns to an acceptable level.

Tilt sensor switches 30 are configured so as to sense when exhaust fan housing 22 is opened and interrupts all power to power flue ventilator 10 in order to prevent possible injury to workers working on power flue vent 10 should they fail to shut off the power supply before doing so.

The present invention may be embodied in other specific forms without departing from the essential attributes thereof, therefore, the illustrated embodiment should be considered in all respects as illustrative and not restrictive, reference being made to the appended claims rather than to the foregoing description to indicate the scope of the invention.

What is claimed is:

1. A power draft system for maintaining draft in a flue for fuel burning appliances, the fuel burning appliances being located within a building, the flue extending from said fuel burning appliance to a location exterior to said building, the power draft system, comprising:

a blower for extracting exhaust flue gases from said flue, said blower comprising a flue gas intake, a flue gas exhaust, a motor and an exhaust fan driven by said motor; and a cooling system for controlling the temperature of said motor, including a first coolant flow inducer operably coupled to said motor for providing a self-induced flow of coolant to said motor, and a second coolant flow inducer, independent of the operation of said motor, for selectively providing an externally assisted flow of coolant to said motor, whereby said cooling system is adapted for selectively controlling the temperature of said motor with self induced coolant flow, assisted coolant flow, or both.

2. The power draft system of claim 1, in which said cooling system comprises a thermostatically controlled coolant circulating device.

3. The power draft system of claim 2, in which said coolant is ambient air.

4. The power draft system of claim 2, in which said second coolant flow inducer comprises a fan, said fan further comprising a shroud whereby said coolant is directed proximate portions of said motor requiring cooling.

5. The power draft system of claim 2, further comprising at least one cooling air intake whereby said ambient air is drawn into said cooling system, said at least one cooling air intake being located such that said flue gas exhaust is directed away from said at least one cooling air intake.

6. The power draft system of claim 1, further comprising a tilt sensitive sensor switch whereby power is interrupted to said power draft system if said power draft system is tilted.

7. The power draft system of claim 1, further comprising a corrosion resistant coating covering portions of said flue gas intake and said flue gas exhaust exposed to said flue gas.

8. The power draft system of claim 1, in which said corrosion resistant coating is high temperature Ryton.

9. The power draft system of claim 1, in which said motor cooling system is actuated above about 150° F. and deactivated at a temperature below about 120° F.

10. The power draft system of claim 1, further comprising a safety control which shuts off said fuel burning appliance when the temperature of said motor rises high enough to cause imminent damage.

11. A cooling system for cooling a motor in a power draft system for maintaining draft in a flue of a fuel burning appliance, the power draft system comprising a blower for extracting flue gases from said flue, said blower including a flue gas intake, a flue gas exhaust, and an exhaust fan driven by said motor, the cooling system comprising;

a first coolant flow inducer operably coupled to said motor for providing a self-induced flow of coolant to said motor, and a second coolant flow inducer, independent of the operation of said motor, for selectively providing an externally assisted flow of coolant to said motor, whereby said cooling system is adapted for selectively controlling the temperature of said motor with self induced coolant flow, assisted coolant flow, or both; and a temperature sensitive control adapted to activate said second coolant flow inducer at a first desired temperature and to deactivate said second coolant flow inducer at a second desired temperature.

12. The cooling system of claim 11, in which said coolant comprises ambient air and said second coolant flow inducer comprises a fan.

13. The cooling system of claim 12, said fan further comprising a shroud adapted for directing said coolant flow proximate portions of said motor requiring cooling.

14. The cooling system of claim 11, in which said temperature sensitive control comprises a thermostatic switch.

15. The cooling system of claim 14, said thermostatic switch being adapted to activate said cooling system at a temperature above about 150° F. and to deactivate said cooling system at a temperature below about 120° F.

16. The cooling system of claim 14, further comprising a safety control which shuts off said fuel burning appliance when the temperature of said motor rises high enough to cause imminent damage.

17. A method of cooling a motor of a power draft system, the power draft system for maintaining draft in a flue of a fuel burning appliance, the method comprising the steps of:

sensing the temperature of portions of said motor that require cooling; and selectively directing a flow of coolant proximate portions of said motor that require cooling in response to said temperature sensing.

18. The method of claim 17, the power draft system comprising a blower for extracting flue gases from said flue, said blower including a flue gas intake, a flue gas exhaust, and an exhaust fan driven by said motor.

19. The method of claim 17, the step of directing a flow of coolant proximate portions of said motor that require cooling comprising securing a fan to a shroud, disposing said shroud about said motor, and drawing ambient air through said shroud and about said portions of said motor that require cooling with said fan.

20. The method of claim 19, the step of sensing the temperature comprising:

disposing a thermostatic switch capable of actuating said fan at a desired temperature proximate said portions of said motor requiring cooling.

21. The method of claim 17, further comprising the step of:

sensing the temperature of said portions of said motor that require cooling and deactivating said fuel burning appliance if said sensed temperature rises to a level that poses an imminent risk of damage to said motor while still directing a flow of coolant proximate portions of said motor requiring cooling.

22. The power draft system of claim 1, in which said motor is a variable-speed motor.

23. The cooling system of claim 11, in which said motor is a variable speed motor.

24. A power draft system for maintaining draft in a flue for fuel burning the fuel burning appliances being located within a building, the flue extending from said fuel burning appliance to a location exterior to said building, the power draft system comprising:

blower for extracting exhaust flue gases from said flue, said blower comprising a flue gas intake, a flue gas exhaust, a motor and an exhaust fan driven by said motor;

a thermostatically controlled motor cooling system whereby coolant is made to flow proximate portions of said motor requiring cooling, maintaining said motor within a desired range of operating temperature; and a tilt sensitive sensor switch whereby power is interrupted to said power draft system if said power draft system is tilted.

* * * * *

UNITED STATES PATENT AND TRADEMARK OFFICE

CERTIFICATE OF CORRECTION

PATENT NO. : 6,450,874 B2
DATED : September 17, 2002
INVENTOR(S) : Hoyez et al.

It is certified that error appears in the above-identified patent and that said Letters Patent is hereby corrected as shown below:

Column 1,
Line 66, delete “lead” and insert -- led --.

Column 6,
Line 16, after “system” delete “,”.

Column 8,
Line 21, delete “variable-speed” and insert -- variable speed --.
Line 25, after the first occurrence of “burning” insert -- appliances, --.
Line 29, before “blower” insert -- a --.

Signed and Sealed this

Twelfth Day of August, 2003

JAMES E. ROGAN
*Director of the United States Patent and Trademark Office*